US010542788B2

(12) United States Patent
Simpson

(10) Patent No.: US 10,542,788 B2
(45) Date of Patent: Jan. 28, 2020

(54) FOOTBALL HELMET HAVING THREE ENERGY ABSORBING LAYERS

(71) Applicant: Safer Sports, LLC, San Diego, CA (US)

(72) Inventor: Elwood J. B. Simpson, Brownsburg, IN (US)

(73) Assignee: Safer Sports, LLC, Carlsbad, CA (US)

( * ) Notice: Subject to any disclaimer, the term of this patent is extended or adjusted under 35 U.S.C. 154(b) by 280 days.

(21) Appl. No.: 15/592,374

(22) Filed: May 11, 2017

(65) Prior Publication Data

US 2018/0326288 A1 Nov. 15, 2018

(51) Int. Cl.
*A42B 3/06* (2006.01)
*A42B 3/20* (2006.01)

(52) U.S. Cl.
CPC ..... *A42B 3/063* (2013.01); *A42B 3/20* (2013.01)

(58) Field of Classification Search
CPC ..... A42B 3/063; A42B 3/128
USPC ..... 2/412
See application file for complete search history.

(56) References Cited

U.S. PATENT DOCUMENTS 3,116,490 A 1/1964 Zbikowski
3,186,004 A 6/1965 Carlini
3,465,363 A 9/1969 Raney
3,720,955 A 3/1973 Rawlings
3,849,801 A 11/1974 Holt et al.
3,906,546 A 9/1975 Gooding
3,935,044 A 1/1976 Daly
3,992,721 A 11/1976 Morton
4,016,734 A 4/1977 Morton
4,020,507 A 5/1977 Morton
4,023,213 A 5/1977 Rovani
4,044,399 A 8/1977 Morton
4,101,983 A 7/1978 Dera et al.
4,404,690 A 9/1983 Farquharson
4,912,778 A 4/1990 Daniels
4,937,888 A 7/1990 Straus
4,996,724 A 3/1991 Dextrase
5,093,936 A 3/1992 Copeland
5,150,479 A 9/1992 Oleson
5,271,103 A 12/1993 Darnell
5,272,773 A 12/1993 Kamata
5,448,780 A 9/1995 Gath
5,450,631 A 9/1995 Egger
5,829,065 A * 11/1998 Cahill ..... A42B 3/08 2/418
5,871,271 A 2/1999 Chien
(Continued)

FOREIGN PATENT DOCUMENTS

NL 2005798 1/2010

*Primary Examiner* — Gloria M Hale
(74) *Attorney, Agent, or Firm* — Stetina Brunda Garred & Brucker

(57) ABSTRACT

A football helmet is disclosed that includes a shell constructed of fiber reinforced epoxy resin, a thin resilient outer liner adjacent the inner shell surface, a thicker resilient middle liner and a thin resilient inner liner. The three liners are preferably fabricated from expanded polypropylene or suitable substitute having comparable resilient energy absorbing properties. The inner and outer liners are made from higher impact absorbing material than the impact absorbing material of the middle liner. The helmet also includes fitment pads, jaw pads, a face mask, and moisture absorbing cloth material.

10 Claims, 5 Drawing Sheets

(56) References Cited

U.S. PATENT DOCUMENTS 5,915,537 A 6/1999 Dallas et al.
5,940,889 A 8/1999 Shirai
6,032,297 A 3/2000 Barthold et al.
6,073,271 A 6/2000 Alexander et al.
6,154,889 A 12/2000 Moore et al.
6,219,850 B1 4/2001 Halstead et al.
6,604,246 B1 8/2003 Obreja
7,328,462 B1 2/2008 Straus
40,422 A1 1/2010 Morgan
7,676,854 B2 3/2010 Berger et al.
7,841,025 B1 11/2010 Fink et al.
8,347,419 B1 1/2013 Cleva
8,615,817 B2 12/2013 Phillips
8,640,267 B1 * 2/2014 Cohen ..... A42B 3/063 2/411
8,782,819 B1 7/2014 Culpepper
9,572,390 B1 2/2017 Simpson
9,603,408 B2 3/2017 Simpson
2001/0011388 A1 8/2001 Nelson et al.
2002/0068152 A1 6/2002 Heath et al.
2002/0120978 A1 9/2002 Moore
2004/0025231 A1 2/2004 Ide et al.
2005/0278834 A1 12/2005 Lee
2006/0123526 A1 6/2006 Lim
2007/0000032 A1 1/2007 Morgan
2009/0222964 A1 * 9/2009 Wiles ..... A42B 3/125 2/6.6
2010/0171349 A1 7/2010 Dellanno
2010/0180362 A1 * 7/2010 Glogowski ..... A42B 3/145 2/411
2010/0180363 A1 * 7/2010 Glogowski ..... A42B 3/122 2/414
2010/0186150 A1 * 7/2010 Ferrara ..... A42B 3/128 2/412
2010/0258988 A1 10/2010 Darnell et al.
2011/0061154 A1 3/2011 Turner et al.
2011/0277223 A1 11/2011 Turner
2011/0296594 A1 * 12/2011 Thomas ..... A42B 3/124 2/414
2012/0005810 A1 1/2012 Cheng
2012/0017358 A1 1/2012 Princip et al.
2012/0036620 A1 * 2/2012 Harris ..... A42B 3/127 2/414
2012/0047635 A1 3/2012 Finiel et al.
2012/0052249 A1 3/2012 Turner
2012/0060251 A1 3/2012 Schimpf
2012/0216327 A1 8/2012 Turner
2012/0233745 A1 * 9/2012 Veazie ..... A42B 3/121 2/413
2013/0061375 A1 3/2013 Bologna et al.
2013/0340146 A1 12/2013 Dekker et al.
2014/0007324 A1 * 1/2014 Svehaug ..... A42B 1/08 2/412
2014/0020158 A1 1/2014 Parsons et al.
2014/0196198 A1 * 7/2014 Cohen ..... A42B 3/063 2/414
2015/0223546 A1 * 8/2015 Cohen ..... A42B 3/063 2/412
2016/0015111 A1 * 1/2016 Latruffe ..... A42B 3/06 2/412

* cited by examiner

FOOTBALL HELMET HAVING THREE ENERGY ABSORBING LAYERS

FIELD OF THE INVENTION

This invention relates in general to protective head gear and more specifically to football helmets.

BACKGROUND OF THE INVENTION

Helmets have long been worn in the sport of football to protect a player's head from injury resulting from impact with other players, ground impact, or impact with objects on or off the field. Typical prior art helmets include an outer shell made from durable plastic materials, a liner made from a shock absorbing material, a face guard and a chin strap which also functions in some designs as a chin protector. Resilient fitment pads that "fit" the helmet to the wearer are typically situated about the inner periphery of a football helmet and provide a means to eliminate a loose fitting helmet. However, fitment pads provide little if any impact absorption properties to the helmet since comfort demands that fitment pads have a fairly low compressive strength. Helmet liners have taken several forms over the years, including encased foam padding, fluid filled jackets or pockets, air inflated bags lining the inner surface of the helmet and other design approaches.

It is well recognized that no helmet can completely prevent injuries to persons playing the sport of football. The very nature of football is quite physical with much emphasis placed on strength and speed of the players. As players have increased their strength and speed, corresponding improvements in safety equipment, specifically helmets, has not occurred. Shock attenuation and impact force absorption are of foremost importance in the design of a football helmet.

Serious concerns have been raised in recent years regarding concussion injuries suffered by athletes while playing football and the long term affect such injuries have on the mental and physical health of those afflicted. Some commentators suggest there may be significant consequences for continuing to play football before recovery from a concussion injury has taken place. Later life cognitive difficulties suffered by former football players are now being associated with concussion injuries received while playing football.

Recently, researchers found football athletes were three times more likely to die from Alzheimer's, Parkinson's or Lou Gehrig's disease than the general population. Further, the adverse impact on football as a result of chronic traumatic encephalopathy (CTE) diagnosis in many deceased players has caused great alarm amongst all involved with the sport. CTE is believed by experts to result from concussion events and may even be caused by smaller concussive events repeated over an extended period of time where the player does not exhibit concussion symptoms, as opposed to an acute concussion event having well known and identifiable symptoms such as dizziness, headaches, nausea, etc.

Given the recent media coverage of high profile football players who received concussion injuries while playing football and have later in life suffered from maladies and diseases of the brain resulting in abnormal life experiences and behavior, it is abundantly clear that more attention and effort must be expended to protect players from such injuries.

In view of the need for better football helmet protection from concussions, any new development in football helmet design that improves the impact absorption or impact attenuation characteristics of a helmet and lessens the forces transmitted to the head of a player is needed by those participating in the sport of football as well as desired by parents of children who play football.

SUMMARY OF THE INVENTION

A football helmet according to one aspect of the present invention includes a shell having an inner surface, an outer surface, an opening adapted to be over a face area of a wearer, a crown area and wherein the shell is constructed of fiber reinforced epoxy resin and adapted to receive an athlete's head therein, a first energy absorbing layer situated adjacent and in contact with the inner surface of the shell and extending over the crown area of the shell, the first energy absorbing layer having a substantially uniform thickness, the first energy absorbing layer having an inner surface, and the first energy absorbing layer fabricated from resilient energy absorbing material, a liner having an outer surface conforming with the inner surface of the first energy absorbing layer and the inner surface of the shell outside the crown area of the shell, the liner situated within the shell and in contact with the first energy absorbing layer and the shell, the liner having a substantially uniform thickness and fabricated from resilient energy absorbing material, a second energy absorbing layer conforming with and in contact with the inner surface of the liner, the second energy absorbing layer having a substantially uniform thickness, the second energy absorbing layer having an inner surface closely conforming to the head of the wearer, the second energy absorbing layer having an inner periphery located about a lower portion of the inner surface of the second energy absorbing layer, the second energy absorbing layer fabricated from expanded polypropylene, a plurality of fitment pads situated about and attached to the inner periphery of the second energy absorbing layer for sizing the liner to the head of the wearer, a face guard attached to the shell over the face area of the shell, and wherein the first energy absorbing layer and the second energy absorbing layer are fabricated from resilient energy absorbing material having a compressive strength that is greater than the compressive strength of the energy absorbing material used to fabricate the liner.

One object of the present invention is to provide a football helmet having improved head protection elements.

Another object of the present invention is to provide a football helmet that is lighter than prior art helmets.

Still another object of the present invention is to provide a football helmet that includes improved impact attenuation and shock absorbing components that reduce the severity of higher velocity impacts with other players.

Yet another object of the present invention is to significantly reduce impact forces that are transmitted through a football helmet to the head of the player wearing the helmet so that the severity index measured for the helmet is reduced to the lowest possible level.

These and other objects of the present invention will become more apparent from the following description of the preferred embodiment.

DESCRIPTION OF THE PREFERRED EMBODIMENT

Figure 1:
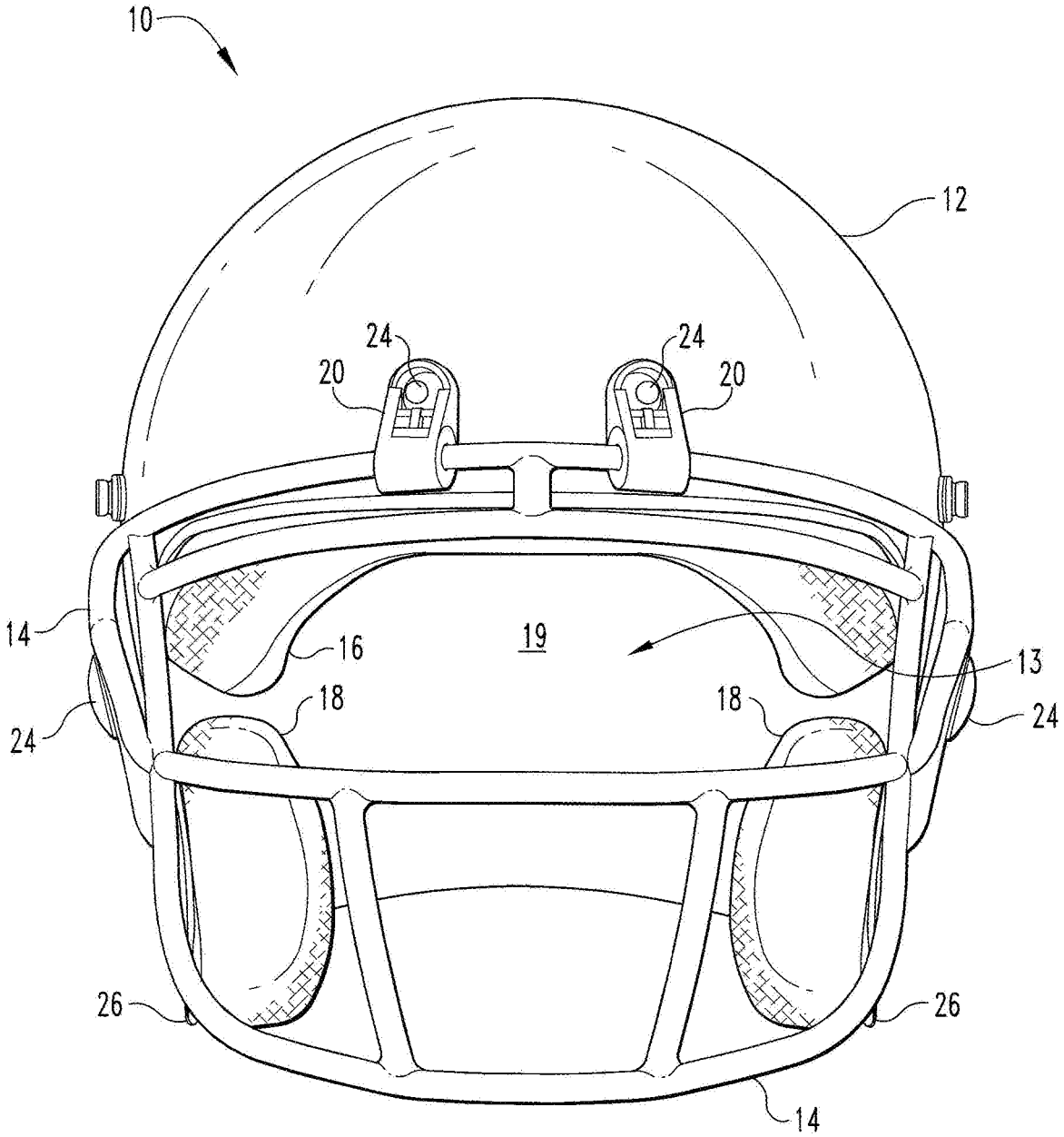
FIG. 1 is a front elevational view of a football helmet according to one aspect of the present invention.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated devices, and such further applications of the principles of the invention as illustrated therein being contemplated as would normally occur to one skilled in the art to which the invention relates.

Figure 2:
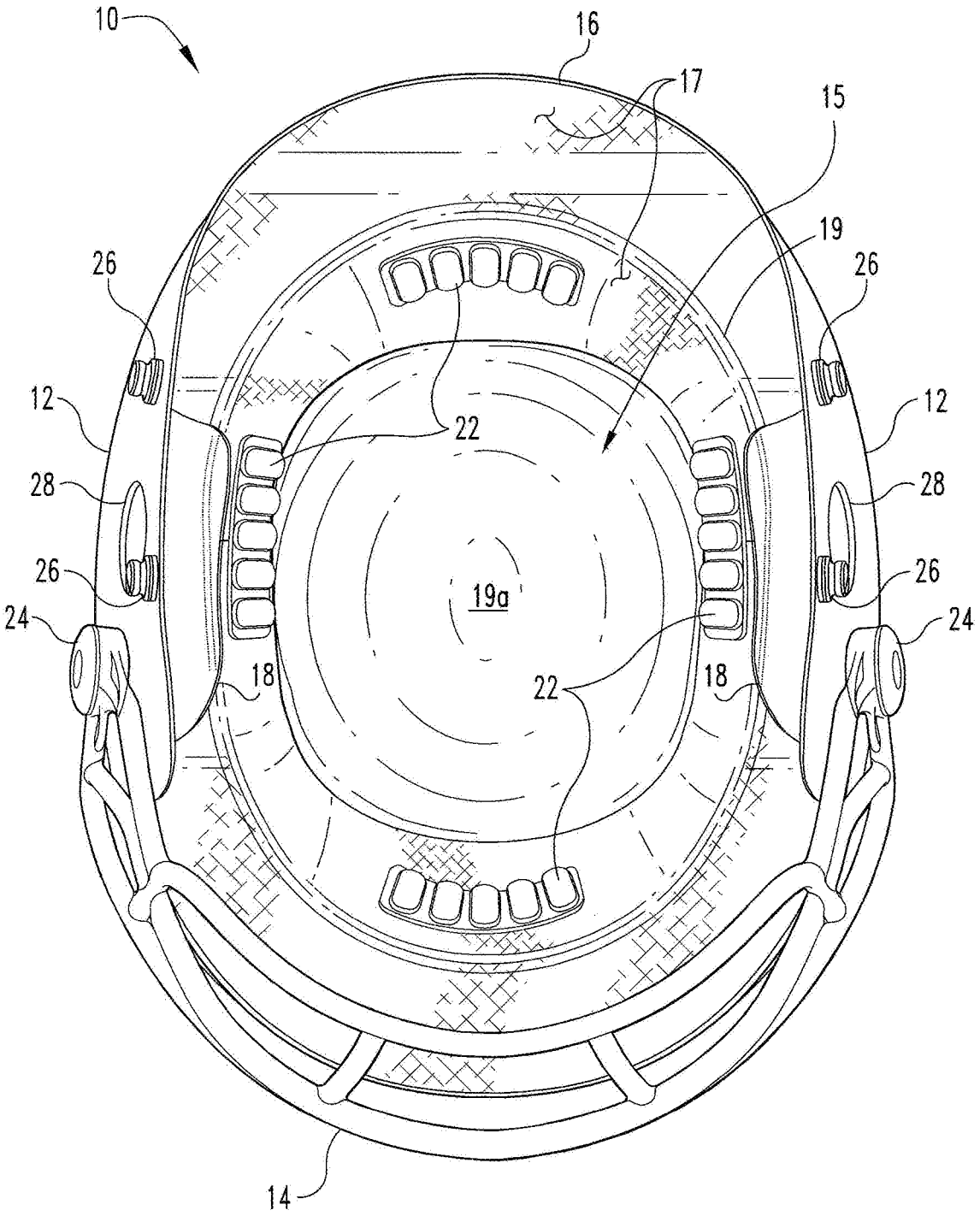
FIG. 2 is a bottom view of the football helmet of FIG. 1.

Referring now to FIGS. 1 and 2, a football helmet 10 according to one aspect of the present invention is shown. FIG. 1 is a front elevational view and FIG. 2 is a bottom view of helmet 10. Helmet 10 includes shell 12, face guard or face mask 14, energy absorbing middle liner 16, energy absorbing inner liner 19 and energy absorbing outer liner 21 (shown in FIG. 3), jaw pads 18, and face guard connectors 20. Face guard connectors 20 and screws 24 secure face guard 14 to shell 12. Face guard connectors 20 are secured to shell 12 by screws 24 and nuts (not shown) situated on the inner surface of shell 12. Jaw pads 18 are attached to shell 12 using snap connectors or hook and loop fasteners (not shown). Chin strap snaps 26 are attached to shell 12 by threaded nuts (not shown) situated on the inner surface of shell 12 that engage a threaded portion of snaps 26 that extend through shell 12. Ear apertures 28 in shell 12 are situated over the player's ears and allow sound waves to readily pass therethrough. Fasteners for attaching face guards, jaw pads and chin straps to football helmets are well known in the art.

Shell 12 is relatively thin (typically less than one-eighth inch or less than 3 mm thick) and constructed of fiber reinforced epoxy resin formed in a shape that is generally conforming with yet larger than a human head. Shell 12 includes a face opening 13 and a head opening 15. Shell 12 is thinner than prior art helmets and weighs substantially less than prior art shells made from polycarbonates or other known plastic materials. Situated within shell 12 are middle liner 16, inner liner 19 and outer liner 21 (shown in FIG. 3). Liners 16, 19 and 21 are fabricated from expanded polypropylene (EPP). Liner 19 has an inner surface 19*a* that conforms with and is slightly larger than the approximate external contours of a human head. The inner surface of liner 19 is covered with a moisture wicking or moisture absorbing cloth material 17 to absorb perspiration from the player's head. The exterior upper surface of liner 16 is shown in more detail in FIG. 3. Fitment pads 22 are attached to inner liner 19 about the inner periphery of liner 19 at multiple locations to achieve a comfortably snug fit of helmet 10 on a football player's head. Fitment pads 22 are made from fabric encased resilient foam padding material and are attached using adhesives, hook and loop fasteners or the like or other attachment means well known in the art. Fitment pads 22 are produced in various thicknesses to accommodate varying head sizes within liner 19. In order to accommodate a large range of head sizes, liners 16, 19 and 21 may also be fabricated in a varying range of thicknesses and in combination with various sized fitment pads all sizes of human heads are accommodated within helmet 10.

Liner 16 is preferably constructed with external dimensions along the head opening 13 and face opening 15 of shell 12 that are slightly larger than the inner dimensions of shell 12 to create a slight interference fit within shell 12. The process for inserting liner 16 within shell 12 includes slightly compressing liner 16 toward the middle at the edges thereof for installation into shell 12. Liner 16 is retained within shell 12 as a result of the subsequent resilient expansion of liner 16 against the inner surfaces of shell 12. Alternatively, liner 16 may be constructed with external dimensions in the face and head openings to be an exact fit to the inner surfaces of shell 12 and liner 16 is then attached to the inner surfaces of shell 12 using contact adhesive or the like. Inner and outer liners 19 and 21 may also be fabricated from visco-elastic polymer material well known for their energy absorption properties and resilience.

Liners 16, 19 and 21 are preferably fabricated from expanded polypropylene (EPP) since it is a highly versatile closed-cell bead foam or foam form of polypropylene that provides a unique range of properties, including outstanding energy absorption, multiple impact resistance, thermal insulation, buoyancy, water and chemical resistance, exceptionally high strength to weight ratio and 100% recyclability. EPP has very good impact characteristics due to its low stiffness and resilience; this allows EPP to resume its shape after experiencing a high force impact. EPP foam possesses superior cushioning properties, is able to absorb kinetic impacts very well without breaking, retains its original shape, and exhibits memory form characteristics which allow it to return to its original shape in a short amount of time. Expanded polypropylene, in general, is not only resilient but also resistant to most solvents and glues. The liners may also be constructed of alternate materials well known in the art that are capable of absorbing energy from an impact yet resilient.

Figure 3:
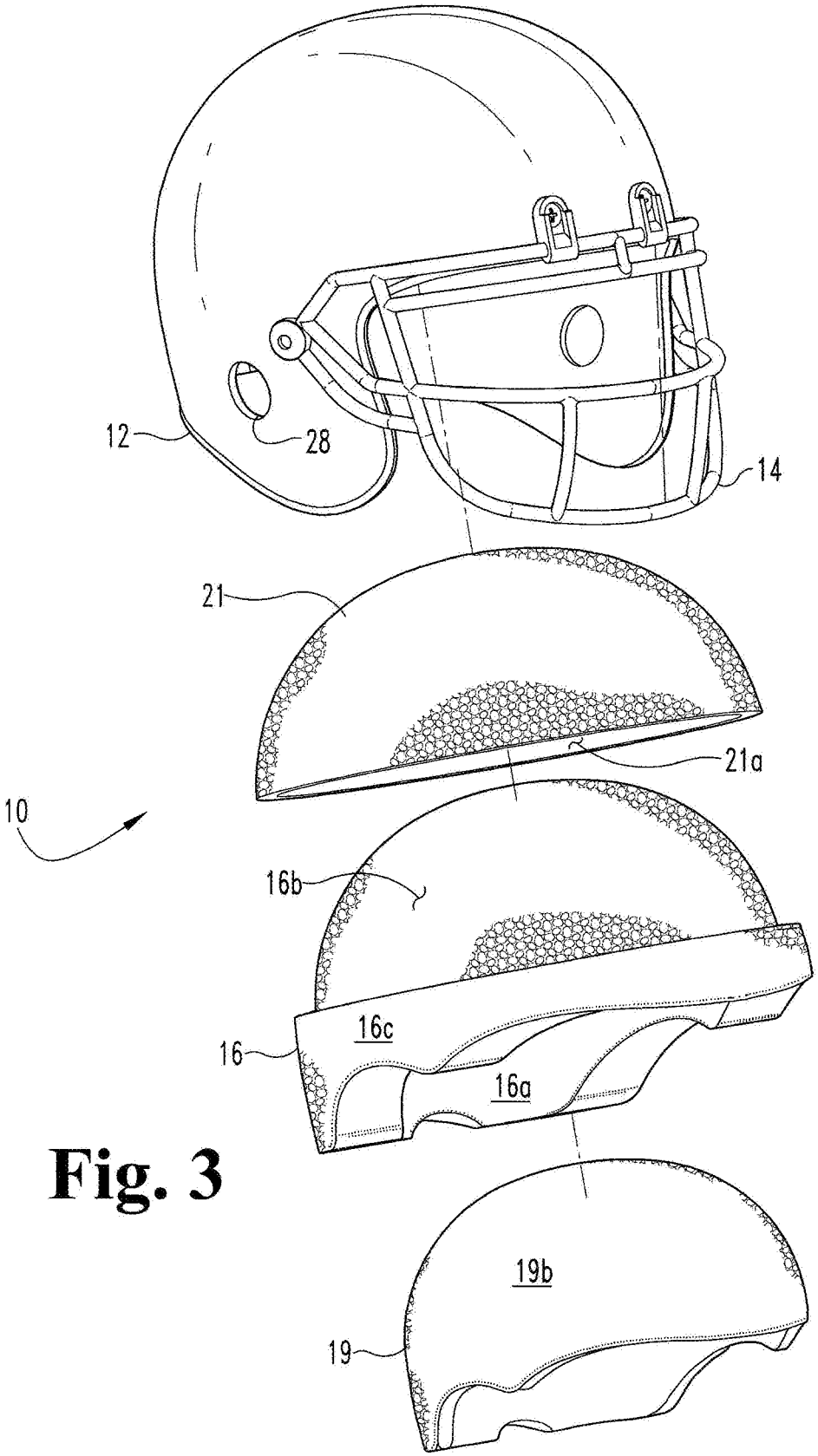
FIG. 3 is an exploded perspective view of the helmet of FIG. 1.

Referring now to FIG. 3 a perspective exploded view of helmet 10 is shown, depicting shell 12, liner 16, inner liner 19 and outer liner 21 components. Prior to insertion of liner 16 into shell 12, outer liner 21 is situated on recessed surface 16*b* of liner 16. Liner 19 is inserted within liner 16 as shown. Liner 19 is fabricated to conform precisely with the interior curved surface 16*a* of liner 16 so that continuous surface contact exists between surfaces 19*b* of liner 19 and surface 16*a* of liner 16. The dimensions of recessed area 16*b* are such that liner 21 is in full surface contact with the recessed external surface area 16*b* and the inner surface of shell 12. It is important that no air gaps are present within the assembly between adjacent liner components shown in FIG. 3. The assembly consisting of liner 16 and liner 21 conforms with and is in contact with the interior surface of shell 12. Liners 16, 19 and 21 have no air gaps between adjacent liner layers within shell 12, thus the interior surface 21*a* of liner 21 is fabricated to exactly fit surface 16*b* of liner 16, and surface 19*b* of liner 19 precisely conforms with surface 16*a* of liner 16. Liner 16 is preferably much thicker than liners 19 and 21.

Liners 16 and 19 are shown in FIG. 3 with moisture wicking material 17 removed. Shell 12 is shown with jaw pads 18 removed to more clearly illustrate the assembly process of liner 16, liner 19 and liner 21 within shell 12. The energy absorbing material in liners 19 and 21 have a compressive strength greater than the compressive strength or impact attenuation property of the expanded polypropylene of liner 16. Peripheral surface 16*c* of liner 16 is compressed slightly to enable insertion of liner 16 within shell 12. Face guard 14 and ear apertures 28 are also shown in FIG. 3.

Figure 5:
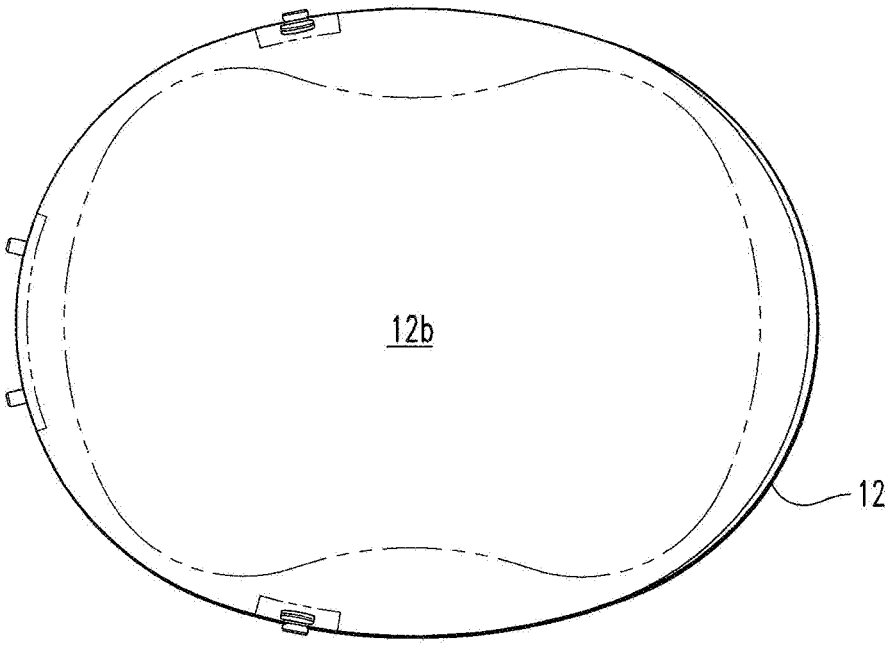
FIG. 5 is a plan view of the helmet shell depicting areas wherein additional reinforcing material are applied.
Figure 4:
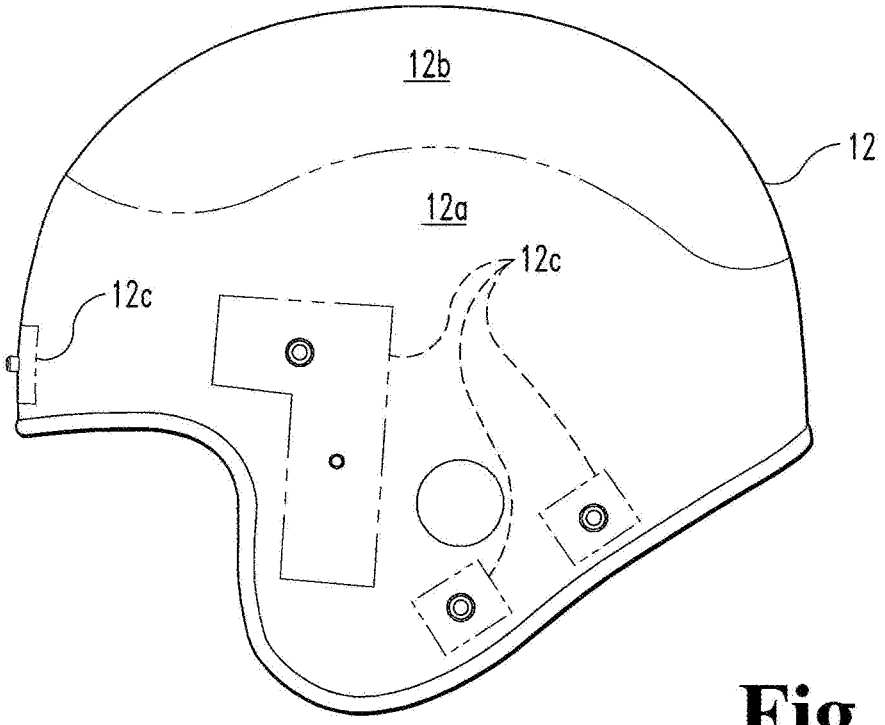
FIG. 4 is a side view of the helmet shell depicting areas wherein additional reinforcing material are applied.

Referring now to FIGS. 4 and 5, a side elevational view and a plan view of shell 12 are shown, respectively, with a number of areas defined by broken lines that depict locations wherein the amount of reinforcing material applied during fabrication of shell 12 will vary. In general, shell 12 includes four (4) layers of reinforcing mesh in area 12*a*, three (3) layers of reinforcing mesh in area 12*b*, and six (6) layers of reinforcing mesh in areas marked 12*c*. The variation in reinforcing material layer count is directly impacts the desired strength and amount of resiliency or stiffness desired for the noted regions. In area 12*b* over the brain it is desired that shell 12 have more "resilience" or "flex" upon heavy impact. Area 12*a* may be slightly stiffer in resilience, thus four layers are applied therein. Significant strength is desired in area 12*c* where face guards, jaw pads and chin straps are attached, thus six layers of reinforcing material are applied therein during fabrication of shell 12.

Figure 6:
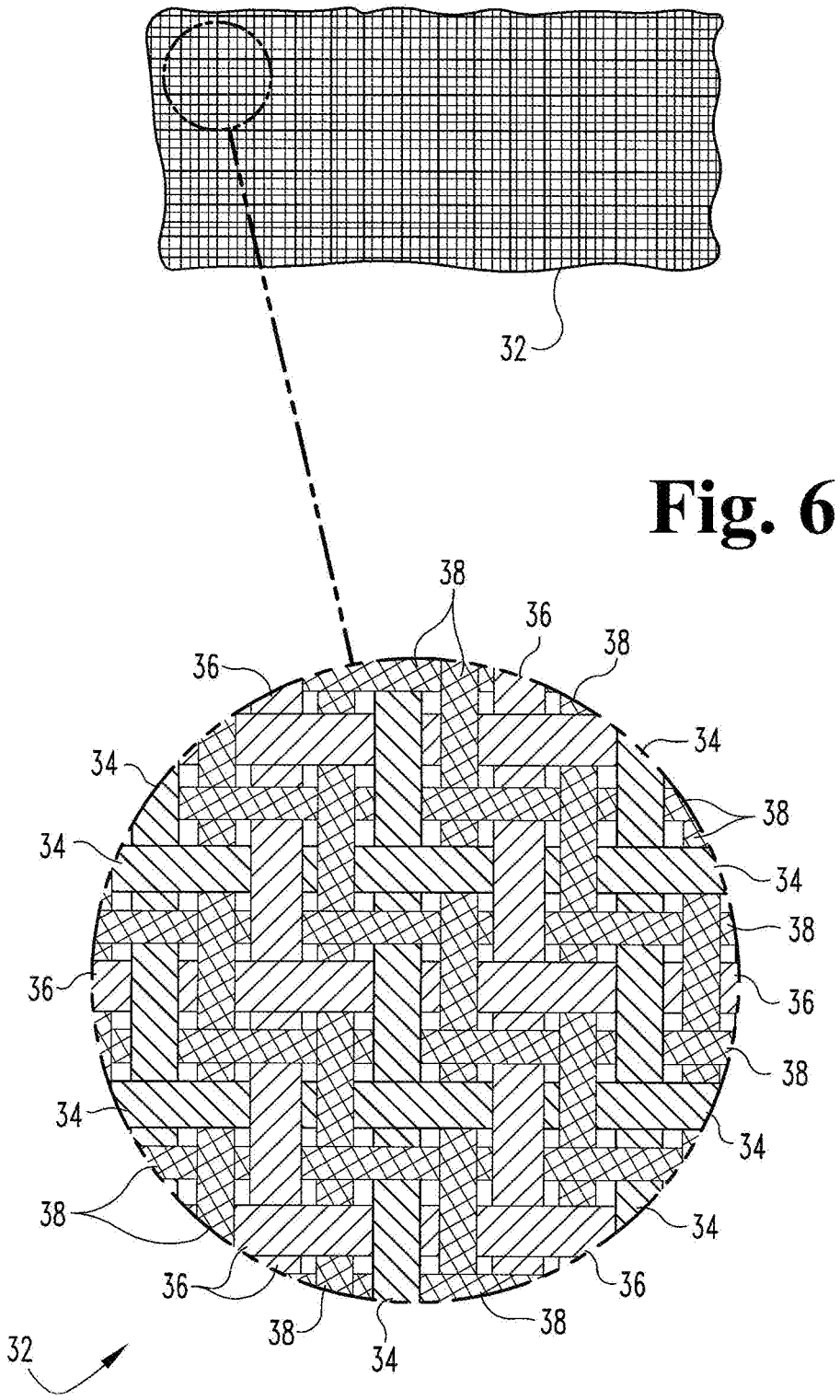
FIG. 6 is a plan view of the reinforcing material used to construct the helmet shell with an enlarged view of the fiber makeup.

Referring now to FIG. 6, a detailed view of the reinforcing mesh 32 encased in epoxy resin to fabricate shell 12 is shown. Mesh 32 includes preferably three different fiber types, namely, carbon fibers, fiberglass fibers and Kevlar® fibers. One combination of fibers that provides desirable strength characteristics along with resiliency and toughness includes a 40 (forty) percent carbon fiber, 40 (forty) percent Kevlar® fiber and 20 (twenty) percent fiberglass fiber ratio woven into a mesh as shown in FIG. 9. Kevlar® fiber bundles 34, carbon fiber bundles 36 and fiberglass fiber bundles 38 are cross woven as shown to fabricate mesh 32. The Kevlar® fiber bundles 34 and carbon fiber bundles 36 in mesh 32 are larger in individual fiber count than the fiberglass fiber bundles 38 such that the approximate fiber makeup of 40% Kevlar® fiber, 40% carbon fiber and 20% fiberglass fiber content is achieved.

Liner 16 is substantially thicker than liners 19 and 21 and is constructed of lower density EPP versus the density of the EPP used to fabricate liners 19 and 21. Lower density EPP will physically deform more in response to the same force applied to a higher density EPP material. Operationally, the combination of liners 16, 19 and 21 serve to absorb impact energy and attenuate impact forces transmitted to the head of the wearer.

Liners 19 and 21 are fabricated from EPP having a higher density than that of the EPP used to fabricate liner 16. Thus, liners 19 and 21 have a higher energy absorbing capability per unit thickness or increased impact attenuation as a result of the higher density of the EPP therein. The density of the EPP used to fabricate liner 16 is typically between 2 and 4 pounds per cubic foot and the density for the EPP used in fabricating liners 19 and 21 is typically between 4 and 6 pounds per cubic foot, though it is contemplated that other combinations of densities may be desirable to achieve specific impact attenuation results for the combination of liners 16, 19 and 21. For example, where players are young and smaller with less speed and strength abilities, lower commensurate densities of EPP for the liners may be more appropriate.

It is foreseeable that liners 16, 19 and 21 may be fabricated as a unitary liner by use of sophisticated EPP molding techniques that are presently known or may be developed in the future. If liners 16, 19 and 21 are fabricated as a unitary liner component then the outer surface of the unitary liner shall conform with the inner surface of shell 12. The unitary liner has an inner surface closely conforming to the head of the wearer. Further, the unitary liner would include a substantially uniform thickness and be fabricated from EPP. The expanded polypropylene at the outer surface and at the inner surface of the unitary liner up to a predetermined depth is fabricated from a higher density EPP than the inner or central regions of the liner.

Many different materials are known that have energy absorbing characteristics coupled with resiliency as exhibited by EPP and the substitution of such materials in the present invention is contemplated. Energy absorbing materials such as viscoelastic polymers having compressive strength or impact attenuation properties similar to the inner and outer liner components of the present invention are known. One such product is identified in my prior U.S. Pat. No. 9,572,390 and is sold under the trade name Zoombang® and is contemplated as a substitute material for the inner and outer liners of the present invention.

Football helmet performance or impact protection properties are oftentimes measured in accordance with standards developed by the National Operating Committee on Standards for Athletic Equipment (NOCSAE), an organization formed in the late 1960's to commission research in sports medicine and science and establish standards for athletic equipment certification and testing. NOCSAE has promulgated various standards defining the test equipment used to certify football helmet performance as well as testing procedures, equipment calibration procedures, and measurement and determination of performance characteristics of football helmets as well as various other athletic equipment. A "Severity Index" (SI) calculation was developed by NOCSEA as a measure of the severity of impact with respect to the instantaneous acceleration experienced by a player wearing a football helmet as the helmet is impacted by an external force. Side, frontal, rear and vertical impact SI values are some of the test data determined for a football helmet during certification testing. Helmet design improvements that produce lower SI test values are of particular interest and desired.

SI values are determined in accordance with the following formula:

$$SI=\int_0^T A^{2.5}dt$$

Where: A is the instantaneous resultant acceleration expressed as a multiple of g (acceleration of gravity); dt are the time increments in seconds; and the integration is carried out over the essential duration (T) of the acceleration pulse.

NOCSAE helmet testing methodology includes a drop test of a headgear or helmet positioned on a headform and situated on a vertically moving assembly where motion of the assembly is guided by vertically oriented twin wire guides. The assembly, propelled by gravity, is dropped in order to achieve a desired free fall velocity. The helmet impacts a stationary thick rubber pad situated beneath the moving headform assembly. At impact, the instantaneous acceleration is measured by triaxial accelerometers positioned within the headform and the detected acceleration values are used to calculate an SI value corresponding with the measured helmet velocity just prior to impact. Peak acceleration values detected as the velocity of the test assembly rapidly changes from a gravity drop induced velocity to zero velocity at impact are of significant import.

The combination of elements, in particular the three layer impact absorbing liner, of the present invention provide a substantial improvement in severity index (SI) values versus my prior helmet invention described in U.S. Pat. No. 9,572,390. The below tables set forth test data showing acceleration and SI values determined for forehead, rear and side impact events of the present invention versus my prior helmet designs.

Table 1 sets forth measured acceleration and velocity values for ten forehead test impacts measured for a helmet fabricated in accordance with my prior art helmet designs shown in U.S. Pat. No. 9,572,390. NOCSAE test equipment was used to produce all test values set forth below. A calculated SI value is also set forth in the table for each test impact. Peak acceleration values are in "g-forces" and velocity is measured in feet per second just prior to impact. Table 2 includes test values for forehead impacts on a helmet incorporating the features of the present invention described above. Both Table 1 and 2 include measured acceleration values for impacts at a velocity of approximately 18 ft/sec.

TABLE 1

| Forehead Impact Prior Art Helmet | | |
|---|---|---|
| SI | Peak Acceleration (g's) | Velocity (ft/sec) |
| 362 | 71 | 18.08 |
| 401 | 82 | 18.05 |
| 416 | 82 | 17.99 |
| 423 | 82 | 18.05 |
| 428 | 81 | 18.07 |
| 428 | 82 | 18.05 |
| 425 | 81 | 18.03 |
| 419 | 81 | 17.96 |
| 410 | 79 | 17.67 |
| 433 | 86 | 17.93 |
| Avg. SI | Avg. Peak Accel. | |
| 414.5 | 80.7 | |

TABLE 2

| Forehead Impact Present Invention Helmet | | |
|---|---|---|
| SI | Peak Acceleration (g's) | Velocity (ft/sec) |
| 297 | 58 | 17.98 |
| 310 | 62 | 17.99 |
| 309 | 60 | 17.88 |
| 321 | 68 | 18.12 |
| Avg. SI | Avg. Peak Accel. | |
| 309.25 | 62 | |

Differences in test data are readily observed. Average peak acceleration values in Table 1 of 80.7 g's for a prior art helmet versus a 62 g average acceleration value from Table 2 measured for a helmet of the present invention. The present invention helmet reduced the average g forces transmitted through a helmet from 80.7 to 62 on average in 18 ft/sec velocity impacts, a substantial reduction with corresponding reductions in average SI calculated for the tests of 414.5 versus 309.25, a difference of 105.25 or approximately a 25 percent reduction.

Table 3 sets forth rear helmet impact test data for my prior art helmet and Table 4 includes rear helmet impact test data for a helmet of the present invention.

TABLE 3

| Rear Impact Prior Art Helmet | | |
|---|---|---|
| SI | Peak Acceleration (g's) | Velocity (ft/sec) |
| 416 | 84 | 18.31 |
| 432 | 82 | 18.29 |
| 429 | 87 | 18.14 |

TABLE 3-continued

| Rear Impact Prior Art Helmet | | |
|---|---|---|
| SI | Peak Acceleration (g's) | Velocity (ft/sec) |
| 425 | 87 | 18.19 |
| 421 | 87 | 18.17 |
| 418 | 85 | 17.98 |
| 420 | 85 | 18.18 |
| 394 | 82 | 17.57 |
| 414 | 86 | 18.01 |
| 415 | 86 | 18.07 |
| Avg. SI | Avg. Peak Accel. | |
| 418.4 | 85.1 | |

TABLE 4

| Rear Impact Present Invention Helmet | | |
|---|---|---|
| SI | Peak Acceleration (g's) | Velocity (ft/sec) |
| 342 | 68 | 18.04 |
| 339 | 66 | 18.01 |
| 328 | 64 | 17.89 |
| 335 | 67 | 17.91 |
| Avg. SI | Avg. Peak Accel. | |
| 336 | 66.25 | |

Table 4 values show a marked reduction in peak acceleration values detected during 18 ft/sec velocity rear impact tests. Impact acceleration averages were reduced by 18.85 g's for a helmet of the present invention versus my prior art helmet design for rear impact tests. Peak acceleration is very dependent upon velocity at impact, and comparison of the average calculated SI values shows an average of 418.4 (prior art) versus 336 (present invention), a reduction of 82.4 or an approximate reduction in SI values of 20 percent.

Side impact helmet test data is set forth in Tables 5 and 6, with Table 5 including test data for my prior art helmet and Table 6 including test data for a helmet of the present invention.

TABLE 5

| Side Impact Prior Art Helmet | | |
|---|---|---|
| SI | Peak Acceleration (g's) | Velocity (ft/sec) |
| 464 | 88 | 17.98 |
| 498 | 97 | 18.04 |
| 499 | 94 | 17.99 |
| 505 | 98 | 18.02 |
| 469 | 96 | 17.48 |
| 497 | 98 | 17.97 |
| Avg. SI | Avg. Peak Accel. | |
| 488.7 | 95.2 | |

TABLE 6

| Side Impact Present Invention Helmet | | |
|---|---|---|
| SI | Peak Acceleration (g's) | Velocity (ft/sec) |
| 401 | 80 | 18.04 |
| 404 | 81 | 17.99 |
| 394 | 79 | 17.8 |
| 422 | 82 | 18.14 |
| 401 | 80 | 18.06 |
| Avg. SI | Avg. Peak Accel. | |
| 404.4 | 80.4 | |

Side impact test data evidences a similar improvement in protection from impact forces with an average of 95.2 (prior art) versus 80.4 (present invention) g force reduction and an average SI value of 488.7 (prior art) versus 404.4 (present invention) a reduction of 84.3 or approximately 20 percent.

A substantial reduction of forces transmitted through helmet 10 to the head of the helmet wearer versus the prior art is achieved in view of the composition of the liners 16, 19 and 21, namely a lower impact attenuation material sandwiched between two higher impact attenuation material layers. In addition, the resilience of shell 12 to resiliently deform and absorb some quantity of energy upon impact further serves to provide an improved head protection gear for use by football players of all sizes.

While the invention has been illustrated and described in detail in the drawings and foregoing description of the preferred embodiments, the same is to be considered as illustrative and not restrictive in character, it being understood that only the preferred embodiments have been shown and described and that all changes and modifications that come within the spirit of the invention are desired to be protected.

What is claimed is:

1. A football helmet comprising:

a shell having an inner surface, an outer surface, an opening adapted to be positionable over a face area of a wearer, and a crown area, and wherein said shell is constructed of fiber reinforced epoxy resin and is sized and adapted to receive a head of the wearer therein;

a first energy absorbing layer situated adjacent and in contact with the inner surface of said shell and extending adjacent the crown area of said shell, said first energy absorbing layer having a substantially uniform thickness, said first energy absorbing layer having an inner surface, and said first energy absorbing layer fabricated from a resilient energy absorbing material;

a liner having an outer surface conforming with the inner surface of said first energy absorbing layer and the inner surface of said shell outside the crown area of said shell, said liner situated within said shell and adjacent said first energy absorbing layer and said shell, said liner being fabricated from a resilient energy absorbing material;

a second energy absorbing layer conforming with and in contact with the inner surface of said liner, said second energy absorbing layer having a substantially uniform thickness, said second energy absorbing layer having an inner surface configured to be closely conformable to the head of the wearer, said second energy absorbing layer having an inner periphery located about a lower portion of said inner surface of said second energy absorbing layer, said second energy absorbing layer fabricated from expanded polypropylene;

a plurality of fitment pads situated about and attached to the inner periphery of said second energy absorbing layer for sizing said liner to the head of the wearer;

a face guard attached to said shell over the face area of said shell; and wherein said first energy absorbing layer and said second energy absorbing layer are associated with compressive strength that is greater than a compressive strength of the energy absorbing material used to fabricate said liner.

2. The helmet of claim 1 wherein said liner, and said first energy absorbing layer is fabricated from expanded polypropylene and wherein said first energy absorbing layer and said second energy absorbing layer are made from expanded polypropylene having a greater density than the expanded polypropylene of said liner.

3. The helmet of claim 2 wherein said fiber reinforcement in the crown area is lower than the fiber reinforcement in areas outside the crown area of said shell.

4. A football helmet comprising:

a shell having an inner surface, an outer surface, an opening adapted to be positionable over a face area of a wearer, and a crown are; and wherein said shell is constructed of epoxy resin having a fiber reinforcement and being sized and adapted to receive a head of the wearer therein;

a first energy absorbing layer situated adjacent and in contact with the inner surface of said shell and extending adjacent over the crown area of said shell, said first energy absorbing layer fabricated from expanded polypropylene;

a liner consisting of a liner outer surface and a liner inner surface configured to be closely conformable to the head of the wearer, said liner being disposable adjacent said shell such that said first energy absorbing layer is situated between said liner and said shell in the crown area of said shell, said liner conforming to and in contact with said first energy absorbing layer and said inner surface of said shell, said liner being fabricated from expanded polypropylene, said liner having an inner periphery located about a lower portion of said liner inner surface, and wherein said liner has a compressive strength corresponding to a density of the expanded polypropylene used to fabricate said liner;

a second energy absorbing layer situated adjacent and in contact with the inner surface of said liner and having a substantially uniform thickness, said second energy absorbing layer extending adjacent said liner inner surface, said second energy absorbing layer having an inner surface configured to be closely conformable to the head of the wearer, and said second energy absorbing layer fabricated from expanded polypropylene;

a face mask attached to said shell;

a plurality of fitment pads situated about and attached to the inner periphery of said liner for sizing said liner to the head of the wearer; and wherein said first and said second energy absorbing layers are associated with a higher compressive strength than the compressive strength of said liner.

5. The helmet of claim 4 wherein the fiber reinforcement of said shell consists of a fiber mesh including carbon fibers, poly-paraphenylene terephthalamide fibers and fiberglass fibers.

6. The helmet of claim 5 wherein said fiber reinforcement in the crown area is lower than the fiber reinforcement in areas outside the crown area of said shell.

7. A football helmet comprising:

a shell having an inner surface, an outer surface, an opening adapted to be positionable over a face area of a wearer, and a crown area, and wherein said shell is constructed of epoxy resin having a fiber reinforcement and is sized and adapted to receive a head of the wearer therein;

an outer liner having a substantial uniform thickness and situated adjacent and in contact with the inner surface of said shell and extending adjacent the crown area of said shell, said outer liner fabricated from resilient energy absorbing foam;

a middle liner consisting of an outer surface and a middle liner inner surface, said middle liner positioned relative to said shell such that said outer liner is situated between said middle liner and said shell in the crown area of said shell, said middle liner conforming to said energy absorbing foam, said middle liner being fabricated from expanded polypropylene, said middle liner having an inner periphery located about a lower portion of said middle liner inner surface, and wherein said middle liner has a compressive strength corresponding to a density of the expanded polypropylene used to fabricate said middle liner;

an inner liner situated adjacent and in contact with the inner surface of said middle liner and having a substantially uniform thickness, said inner liner extending over adjacent said middle liner inner surface, said inner liner having an inner surface configured to closely conform to the head of the wearer, and said inner liner being fabricated from resilient energy absorbing foam;

a face mask attached to said shell;

a plurality of fitment pads situated about and attached to the inner periphery of said liner for sizing said liner to the head of the wearer; and wherein the resilient energy absorbing foam used to fabricate said inner liner and said outer liner has a higher compressive strength than the compressive strength of the expanded polyproplene used to fabricate said middle liner.

8. The helmet of claim 7 wherein said outer liner, and said inner liner are fabricated from expanded polypropylene having a higher density than a density of the expanded polypropylene of said middle liner.

9. The helmet of claim 8 wherein said fiber reinforcement in the crown area is lower than the fiber reinforcement in areas outside the crown area of said shell.

10. The helmet of claim 9 wherein said fiber reinforcement of said shell consists of a fiber mesh including carbon fibers, poly-paraphenylene terephthalamide fibers and fiberglass fibers.

* * * * *